US006314745B1

(12) United States Patent
Janke et al.

(10) Patent No.: US 6,314,745 B1
(45) Date of Patent: Nov. 13, 2001

(54) REFRIGERATOR HAVING AN ICE MAKER AND A CONTROL SYSTEM THEREFOR

(75) Inventors: Donald E. Janke, Benton Harbor; Gregory J. Markert, St. Joseph, both of MI (US); Larry J. Manson, Englewood; Husein Allgayer, Huber Heights, both of OH (US); Jim J Pastryk, Sawyer; Mark H Nelson, Berrien Springs, both of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/482,129

(22) Filed: Jan. 12, 2000

Related U.S. Application Data

(63) Continuation-in-part of application No. 09/221,770, filed on Dec. 28, 1998.

(51) Int. Cl.[7] ..... F25C 1/00
(52) U.S. Cl. ..... 62/137; 62/151
(58) Field of Search ..... 62/151, 137; 250/238

(56) References Cited

U.S. PATENT DOCUMENTS

| | | | | |
|---|---|---|---|---|
| 3,545,217 | | 12/1970 | Linstromberg | 62/137 |
| 3,635,043 | | 1/1972 | Sterling | 62/137 |
| 4,756,165 | | 7/1988 | Chestnut et al. | 62/135 |
| 4,920,336 | | 4/1990 | Meijer | 340/619 |
| 4,984,462 | | 1/1991 | Hass, Jr. et al. | 340/619 |
| 5,160,094 | | 11/1992 | Willis et al. | 62/137 |
| 5,694,208 | * | 12/1997 | Ichikawa | 250/238 |
| 6,184,511 | * | 2/2001 | Yamashita | 250/238 |

* cited by examiner

*Primary Examiner*—William E. Tapolcai
*Assistant Examiner*—Mohammad M. Ali

(57) ABSTRACT

The present invention is directed toward a control system for an ice making system. The ice making system includes an ice maker, and an ice storage bin for receiving ice pieces formed by the ice maker. The control system controls the ice maker and includes optic elements for emitting and receiving a beam of light directed across the upper portion of the bin. The control system senses when the ice maker is ready to harvest ice pieces and then directs a beam of light or light signal from a first side of the ice storage bin, across the bin toward a second side of the ice storage bin. The control system senses for the light signal at the second side of the ice storage bin and if ice pieces block the path of the light signal, the control system prevents ice harvesting from the ice maker. The optic elements of the control system include a light emitting element and a light receiving element. If the status of the light receiving element indicates that the optic elements are impaired due to ice or moisture build up, the optic elements are heated.

12 Claims, 9 Drawing Sheets

REFRIGERATOR HAVING AN ICE MAKER AND A CONTROL SYSTEM THEREFOR

This is a continuation-in-part of application Ser. No. 09/221,770, entitled "ICE MAKING AND STORAGE SYSTEM FOR A REFRIGERATOR", filed on Dec. 28, 1998.

BACKGROUND OF THE INVENTION

1. Field of the Invention

The invention relates to an ice making system for a refrigerator and more particularly to an optic control system for an ice making system for use in a freezer compartment of a refrigerator.

2. Description of Related Art

Automatic ice making systems for use in a home refrigerator are well known. Typically, ice making systems include an ice maker mounted within the freezer compartment of the refrigerator and an ice storage receptacle or bin supported beneath the ice maker for receiving the formed ice from the ice maker. The ice maker is commonly mounted within the freezer compartment adjacent the side or rear wall of the freezer compartment such that water and power can be readily supplied to the ice maker. The ice storage receptacle is supported by a shelf structure beneath the ice maker within the freezer compartment. The ice storage receptacle generally extends across the freezer compartment and has a front end adjacent the freezer door. U.S. Pat. No. 4,942,979, to Linstromberg et al. is an example of a prior art ice making system.

In the design of ice maker systems for refrigerators, it is recognized that a control system must be provided for sensing the level of ice disposed in the ice storage bin such that ice pieces are produced when insufficient ice is in the storage bin and ice pieces are not produced when the ice storage bin is filled. A typical ice level sensing system, illustrated by U.S. Pat. No. 5,160,094, to Willis et al., includes an ice maker which employs a bail arm which is periodically lowered into the ice storage bin and then raised back out of the ice storage bin. If the presence of ice pieces interferes with the bail arm being lowered into the ice storage bin, the ice maker is deenergized such that more ice pieces are not produced.

Conventional ice level sensing systems such as the one disclosed by Willis et al. have several drawbacks. Firstly, these mechanical linkage type systems include many moving parts which are subject to failure—particularly in the relatively harsh environment of a freezer. Moving parts may readily become frozen under some circumstances causing the level sensing system to fail. Secondly, conventional ice level sensing systems are not easily applied to a refrigerator ice making system having a door mounted ice storage bin. Door mounted ice storage bins offer several advantages—including making more space available for freezer shelving. However, if a conventional bail arm type ice level sensing system is used with a door mounted ice storage bin, damage may readily occur to the bail arm if the refrigerator door is opened when the bail arm is being lowered into the ice storage bin.

U.S. Pat. No. 3,635,043, to Sterling, is directed to a refrigeration system including a door mounted ice storage receptacle. Sterling discloses having a photoelectric system—employing an incandescent lamp 54 and a photocell 55—for sensing the level of ice in the door mounted bin. The lamp 54 is continuously on and shines a light beam across an ice storage bin. When the beam of light is interrupted by accumulated ice, ice harvesting is prevented. Unfortunately, the system disclosed by Sterling consumes a relatively large amount of energy. Moreover, the incandescent lamp, being continuously on, will have a relatively short life—requiring frequent bulb replacement.

Accordingly, there is a need for robust and effective ice maker control system which may be conveniently employed to sense the level of ice in an ice storage receptacle.

SUMMARY OF THE INVENTION

The present invention is directed toward a control system for an ice making system. The ice making system includes an ice maker, and an ice storage bin for receiving ice pieces formed by the ice maker. The control system controls the ice maker and includes optic elements for emitting and receiving a beam of light directed across the upper portion of the bin. The control system senses when the ice maker is ready to harvest ice pieces and then directs a beam of light or light signal from a first side of the ice storage bin, across the bin toward a second side of the ice storage bin. The control system senses for the light signal at the second side of the ice storage bin and if ice pieces block the path of the light signal, the control system prevents ice harvesting from the ice maker.

The optic elements of the control system include an emitter and a receiver element. If the light signal sensed by the receiver optic element indicates that the optic elements arc impaired due to ice or moisture build up, the optic elements are heated.

The present invention is further directed to a refrigerator which includes a fresh food compartment, a freezer compartment and an ice making system located in a freezer compartment of a refrigerator. The ice making system including an ice maker and an ice storage bin for receiving ice pieces formed by the ice maker. A control system for the ice maker is provided including a microcontroller operatively associated with optic elements. The optic elements include a light emitting element for generating a light signal and a light receiving element for receiving the light signal emitted by the light emitting element. The light emitting element is supported by the freezer compartment for directing the light signal across an upper portion of the bin. The light receiving element is supported by the freezer compartment. The control system energizes the light emitting element when the ice maker is ready to harvest ice pieces such that a pulse of light is generated for forming the light signal. The ice maker is energized if the bin is not yet filled with ice pieces but is maintained de-energized if the bin is completely filled with ice pieces. If the optic elements are impaired due to ice or moisture build up, the optic elements are heated.

DESCRIPTION OF THE PREFERRED EMBODIMENTS

Figure 1:
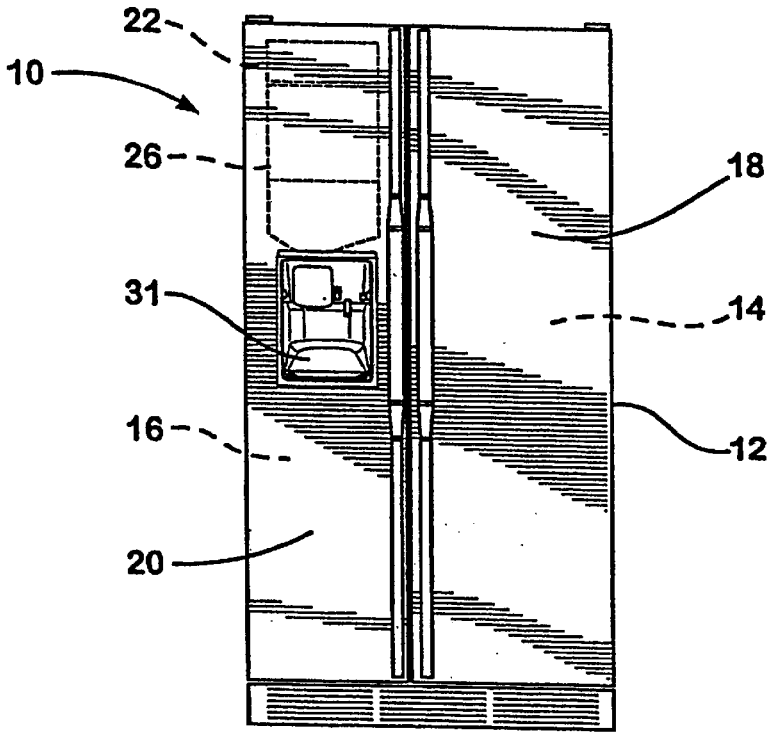
FIG. 1 is a front view of a refrigerator apparatus having an ice storing and dispensing system embodying the present invention.
Figure 2:
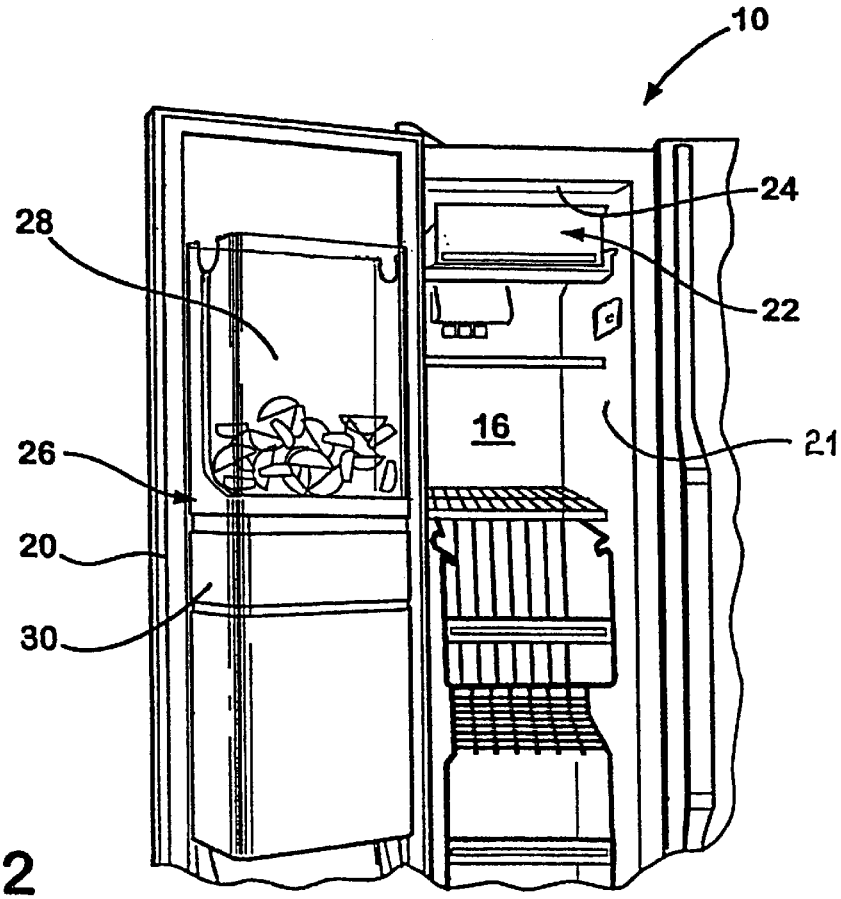
FIG. 2 is a fragmentary perspective view illustrating the ice storing and dispensing system within the freezer compartment of the refrigerator apparatus with the freezer door open.
Figure 3:
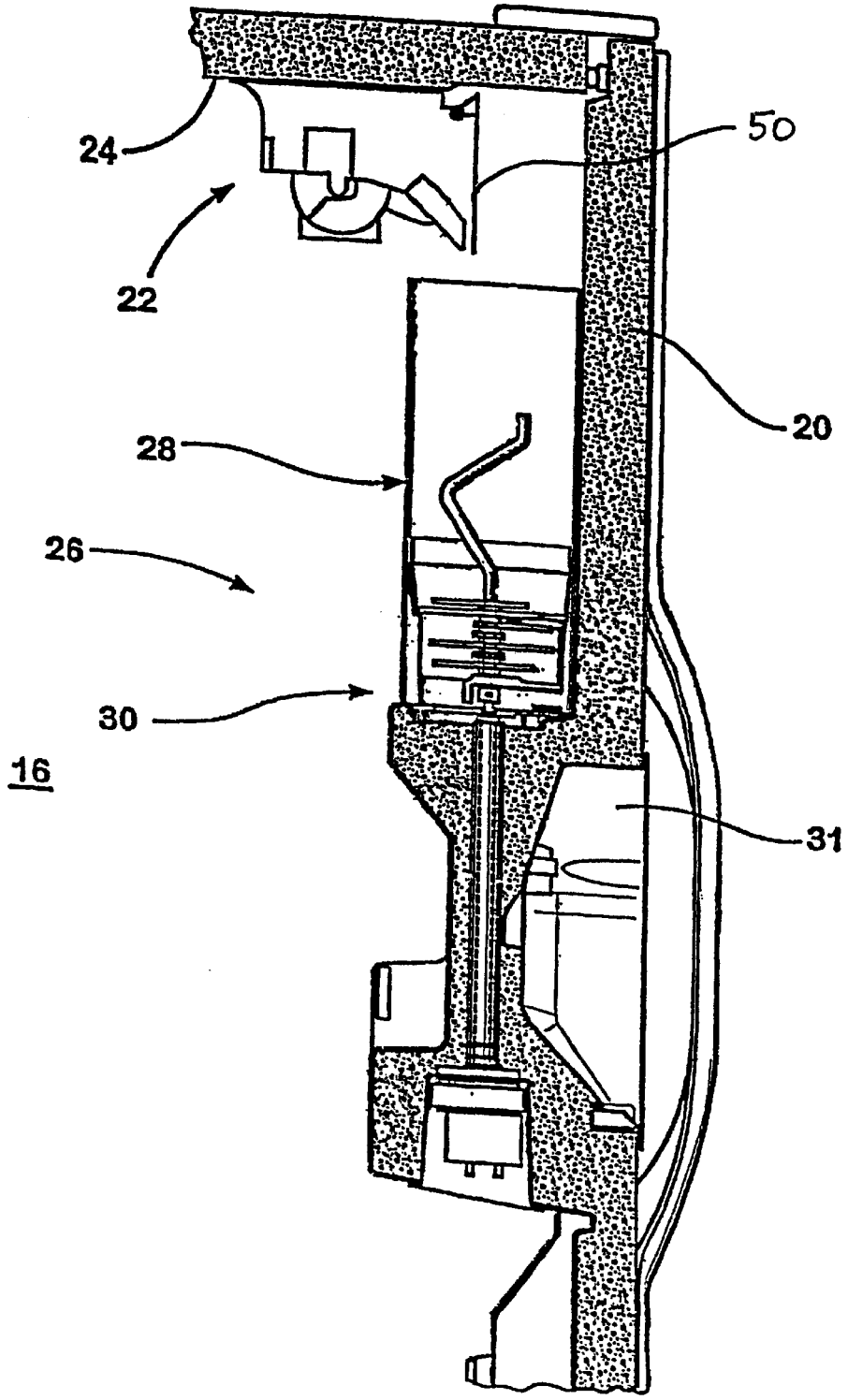
FIG. 3 is a fragmentary, side sectional view of the ice storing and dispensing system of FIG. 1.

In the illustrative embodiment of the invention as shown in FIGS. 1–3, a refrigerator 10, comprising a side-by-side fresh food/freezer configuration, is provided having a cabinet 12 forming an above freezing fresh food compartment 14 and a below freezing freezer compartment 16. Both the fresh food compartment 14 and the freezer compartment 16 are provided with access openings. A fresh food closure member or door 18 and a freezer closure member or door 20 are hingedly mounted to the cabinet 12 for closing the access openings, as is well known.

An ice making assembly 22 is disposed within the freezer compartment 16 having side walls 21 and 23 (see FIG. 4) and a top wall 24. The ice making assembly 22 is mounted to the inside surface of the top wall 24 of the freezer compartment 16. An ice dispensing system 26, mounted to the freezer door 20, is provided below the ice making assembly 22 for receiving ice pieces therefrom. The ice dispensing system 26 includes an ice storage receptacle or bin 28 having an ice crushing system 30. When operated, the ice dispensing system 26 transfers ice pieces from the bin 28 through the freezer door 20 whereby ice pieces may be dispensed through a conventional, forwardly exposed ice dispenser station or external ice service area 31.

Figure 4:
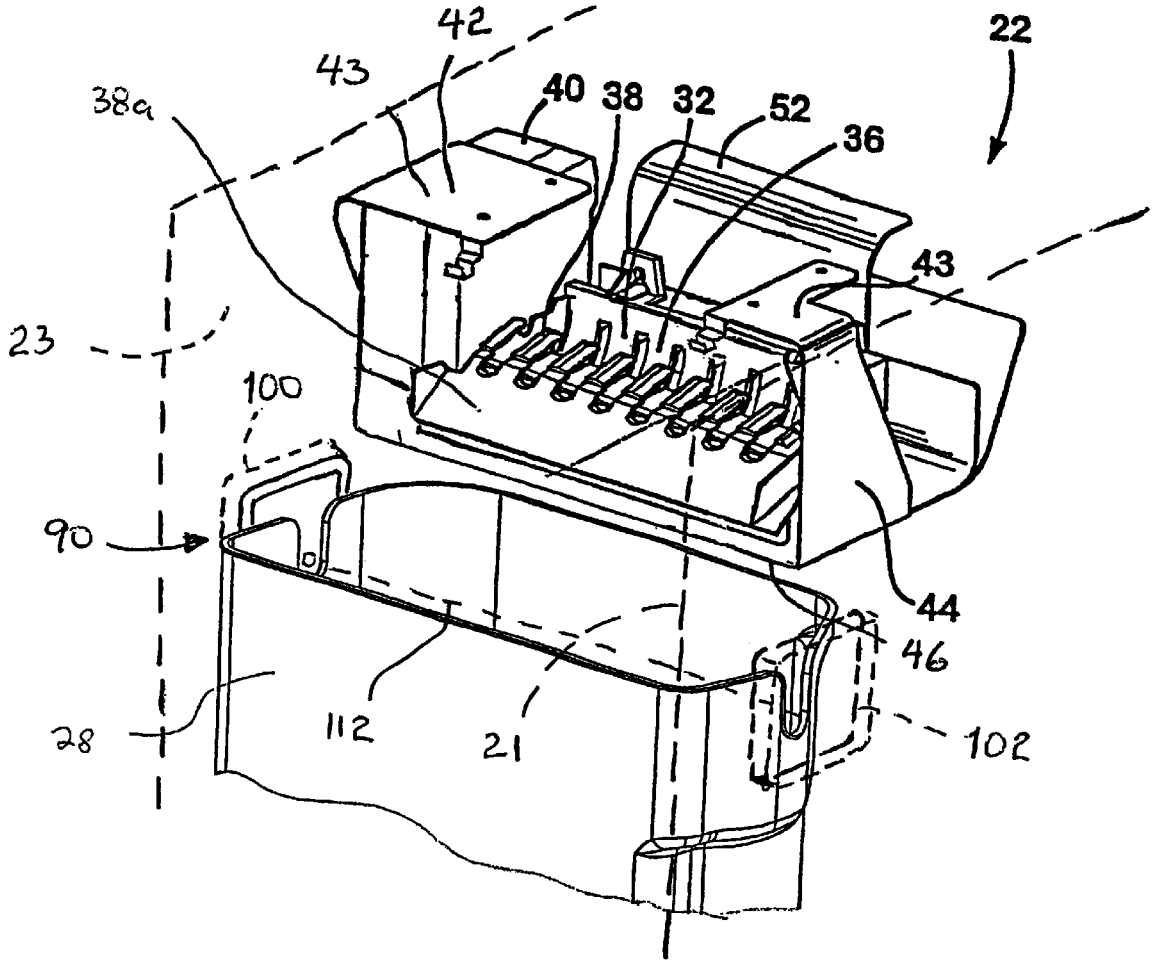
FIG. 4 is a fragmentary, perspective view of the ice storage and dispensing system of the present invention wherein the front cover of the ice maker has been removed.

The present invention may be beneficially employed with any type of known ice maker. In the preferred embodiment, as shown in FIG. 4, the ice maker assembly 22 is a conventional ice piece making apparatus which forms crescent shaped ice pieces. The ice maker 22 includes an ice mold body 36, an ice stripper 38, a rotatable ejector (not shown) and a control module 40. The ice stripper 38 includes a ramp 38*a* for directing harvested ice into the ice storage bin 28. The ramp 38*a* may be integrally formed with the ice stripper, as shown, or may be a separate member. The control module surrounds a control motor 66 (FIG. 5) and gearing system (not shown) which operate to rotate the ejector when ice pieces are ready for harvesting. The ice makers disclosed in U.S. Pat. Nos. 4,649,717 and 5,160,094, herein incorporated by reference, are illustrative of the type of ice maker used in the present invention.

The ice maker 22 may be supported by a mounting bracket 42 along the upper, front portion of the freezer compartment 16. The mounting bracket 42 is attached to the top wall 24 (FIG. 3) of the freezer compartment and forms a member having a generally U-shaped cross section. The bracket 42 includes top mounting surfaces 43 which attach to the top wall 24. Side walls 44 extend downwardly along the sides of the ice maker 22. A bottom wall 46 joins the side walls 44 and forms a heat shield beneath the bottom of the ice maker 22. The ice maker 22 is attached to the mounting bracket 42 via mounting legs (not shown). An air baffle member 52 may be connected to the back of the ice maker 22 to direct the flow of air within the freezer compartment 16 across the ice mold 36 as will be further discussed hereinbelow. A front cover 50 may be attached to the bracket in front of the ice maker 22.

As discussed above, the ice maker may be of any known configuration. In the disclosed embodiment, when ice pieces are ready to be harvested from the ice mold body 36, the ejector and stripper 38 cooperate to remove ice pieces from the mold body 36 and urge the harvested ice pieces to slide forwardly along the stripper 38. The ice pieces slide forward off the stripper 38 and are directed to slide down the ramp 38*a* into the bin 28.

Figure 5:
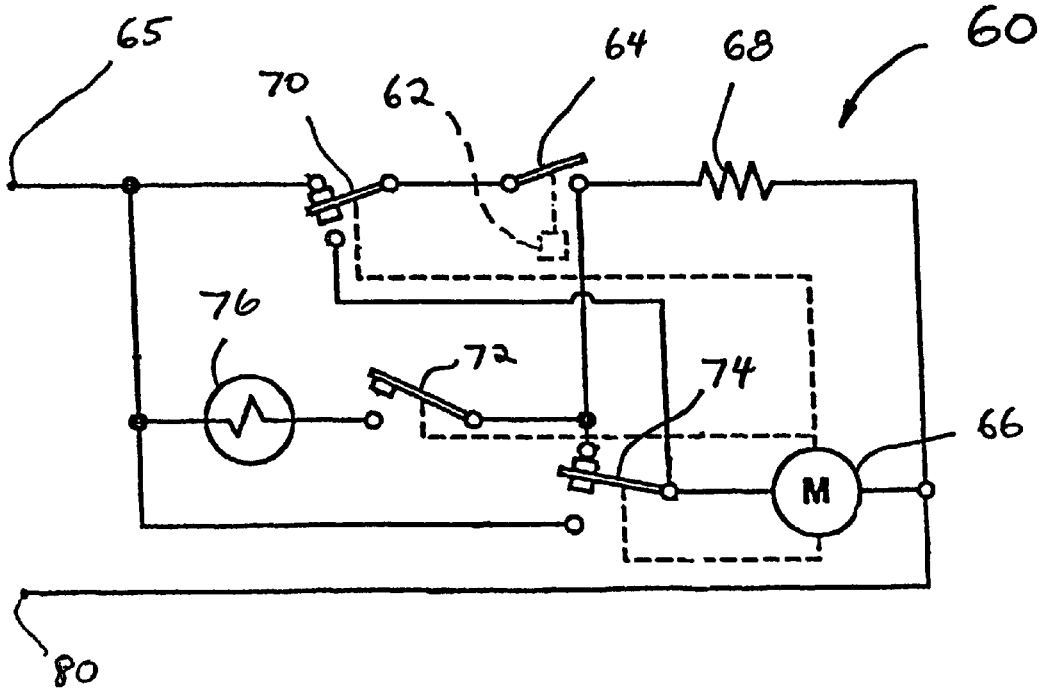
FIG. 5 is a schematic electrical diagram illustrating the ice harvest control circuitry of the ice maker of the present invention.

An ice maker harvest circuit 60 is associated the ice maker, as shown in FIG. 5. The ice maker harvest circuit includes a thermostat 62 responsive to the temperature of water in the ice mold 36. A thermostat switch 64 controlled by the thermostat 62 closes when the temperature of the ice mold is at a temperature indicating that the water in the ice mold is frozen. When the thermostat switch 64 closes, parallel circuit paths are established from point 65 through the motor 66 and an ice mold heater 68 to point 80. The motor 66 drives various cams for operating switches 70, 72 and 74 for maintaining a circuit path through the motor 66 when the thermostat switch 64 opens and for energizing a water valve 76 to refill the ice mold 36 with water after the ice pieces have been harvested. The switches 70 and 74 are reset by the motor 66 to complete an ice harvest cycle.

An optic control system 90 is provided to prevent ice harvesting when the ice storage bin 28 is full of ice pieces. The need for this function is well recognized in the ice maker art. If ice harvesting is not appropriately controlled, the ice maker 22 may make an excessive quantity of ice and overfill the ice storage receptacle 28. In an optical ice level sensing system, light (electromagnetic radiation of any wavelength) is used to sense the presence of ice pieces. An optical ice level sensing system takes advantage of the fact that ice pieces formed by a conventional ice maker, as described above, have a cloudy core which is due to air bubble entrapment, crazing during the freezing process, and water impurities among other things. This cloudy core of the ice pieces blocks a wide range of wave lengths that are generated and sensed by many standard infrared (IR) radiation products.

Figure 6:
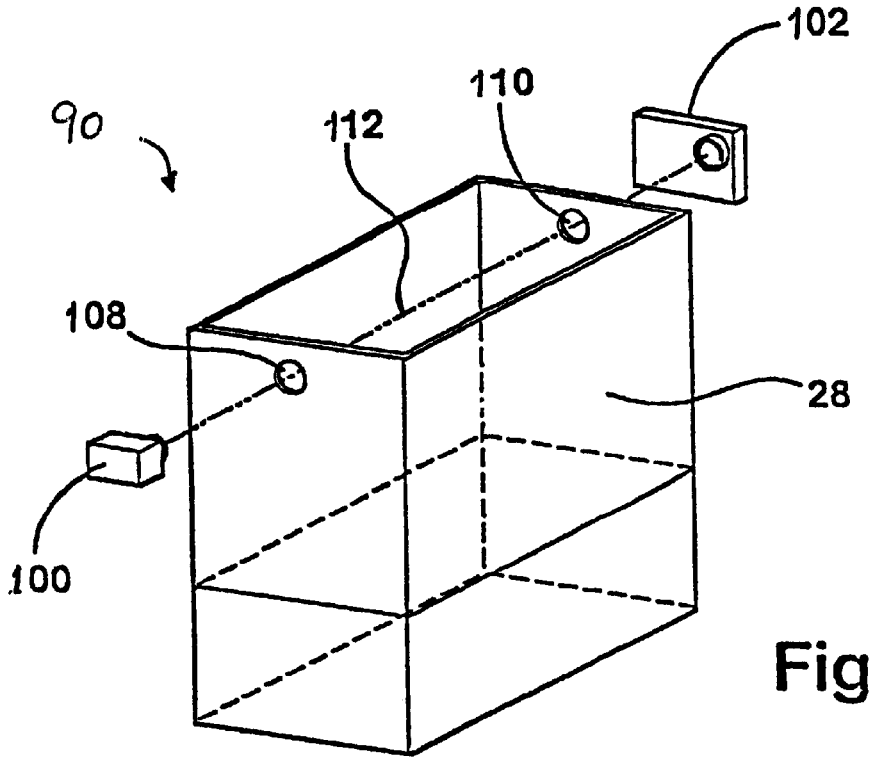
FIG. 6 is a simplified, elevational view of the ice storage bin and the optical control system of the first embodiment.
Figure 7:
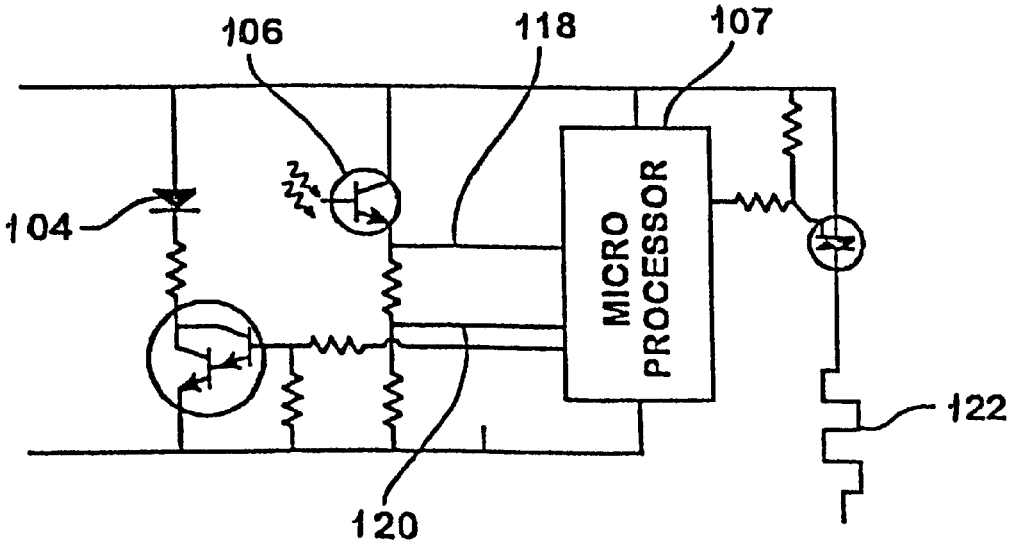
FIG. 7 is a schematic electrical diagram illustrating the circuitry of the optical control system of FIG. 6.

As shown in FIGS. 6 and 7, the optical ice level sensing system includes a light emitter 100 and receiver 102. The emitter 100 may be a printed circuit board (PCB) having a IR photo diode 104 which emits an IR light while the receiver may be a photo transistor 106 mounted to a PCB along with a microprocessor 107 and the necessary electronic circuitry to operate the optical ice level sensing system. The microprocessor 107 controls the operation of the ice level sensing system. The emitter 100 may be mounted to a side wall, such as side wall 23, of the freezer compartment 16 adjacent the top of the ice storage bin 28 while the receiver 102 may be mounted to the opposite side wall 21 of the freezer compartment 16 across from the emitter 100. A pair of openings 108 and 110 are disposed in the ice storage bin 28 near the top surface of the bin 28 such that a line of sight or clear path 112 is created between the emitter and the receiver. The openings 108 and 110 may be slots downwardly extending from the top edge of the bin 28, as shown in FIG. 4.

When the ice maker 22 is ready to harvest ice pieces, IR radiation is generated by the emitter 100 which is directed to pass along the path 112 through the ice storage bin 28 to be received by the receiver 102. As discussed above, ice pieces, due to there cloudy core, will impede the transmission of the IR radiation such that the level of the IR signal received by the receiver can be used as an indicator of the ice level. When the IR photo diode 104 is pulsed, if the photo transistor 106 senses an IR signal, this indicates that the ice bin 28 is not completely filled with ice and the ice maker 22 will be operated to produce and harvest more ice pieces. If the photo transistor 106 does not sense an IR signal when the emitter 100 is pulsed, this indicated that the ice bin 28 is full of ice pieces and further ice will not be harvested.

One problem with an optical ice level sensing system is that ice can coat the photo diode 104 and the photo transistor 106 such that sending and receiving an IR signal is impaired. The signal may be degraded to a point where the optical system provides a false full ice bin signal when in fact the ice storage bin is not full of ice pieces. This occurs particularly quickly when the refrigerator is operated in a hot and humid location wherein when the freezer door 20 is opened, moisture immediately condenses onto the cold surfaces within the freezer compartment 16.

This degradation can be sensed and distinguished from a normal situation as shown in FIG. 7. The microprocessor 107 receives signal 1 across line 118 and signal 2 across line 120. With clean optics, both signal 1 and 2 are read as a logic level "1" when the bin is empty and a logic level "0" when the bin is full. At some point during the degradation process, the lesser voltage at signal 2 will fall below the microprocessor input threshold and be read as a logic level "0" while the greater signal 1 is still large enough to be read as a logic level "1". Whenever signals 1 and 2 differ, ice build up has occurred and it is necessary to clean the optic system.

Heater resistors are shown as 122 which are used to clean the optics system. The heaters are physically located adjacent the photo transistor 106 and the photo diode 104. When optic cleaning is necessary, the heaters 122 are energized to warm the photo transistor 106 and the photo diode 104 such that the accumulated ice is melted away.

Figure 8:
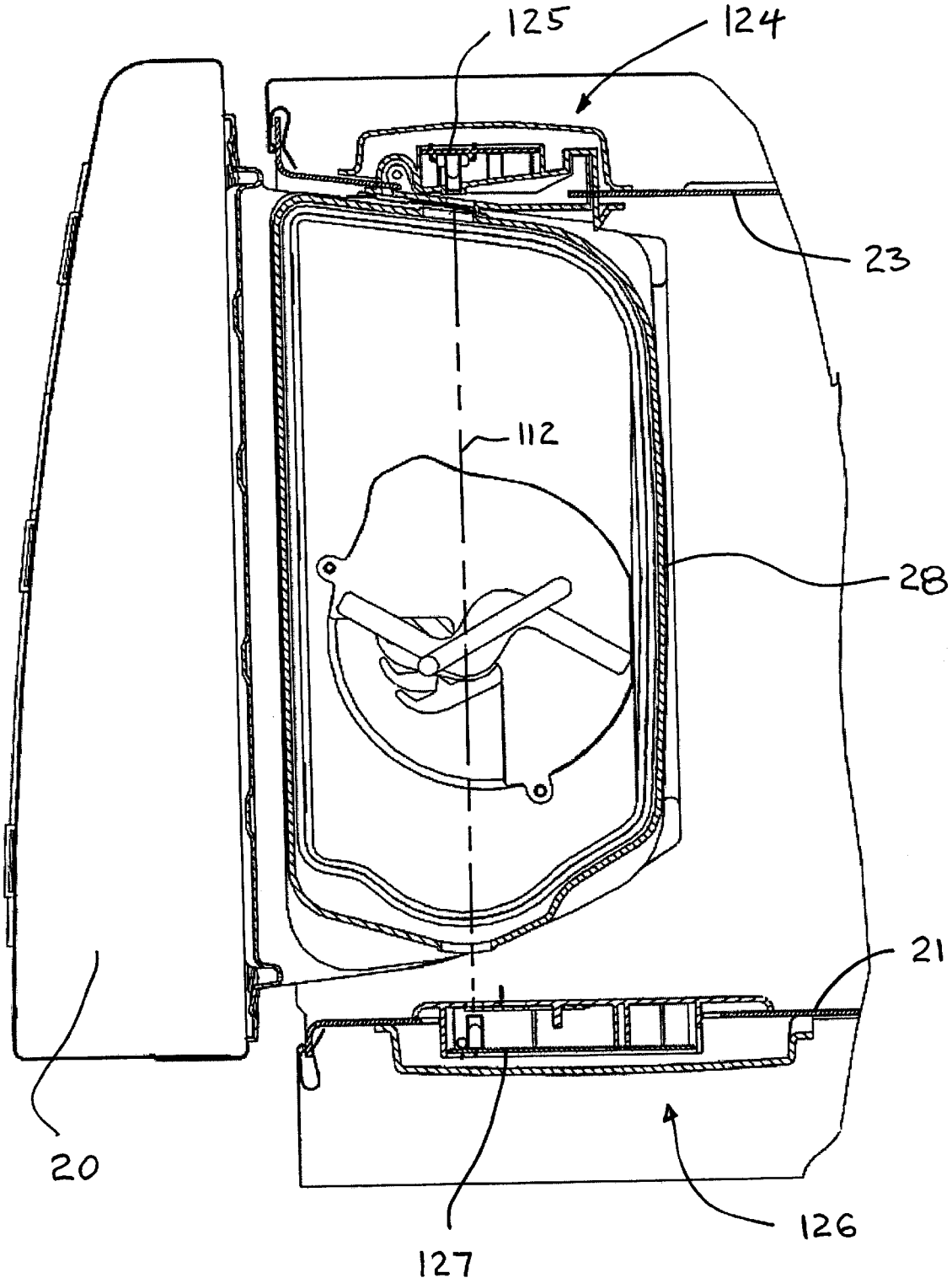
FIG. 8 is a cross sectional view taken through the upper portion of the ice storage bin and illustrating a second embodiment of the present invention.
Figure 9:
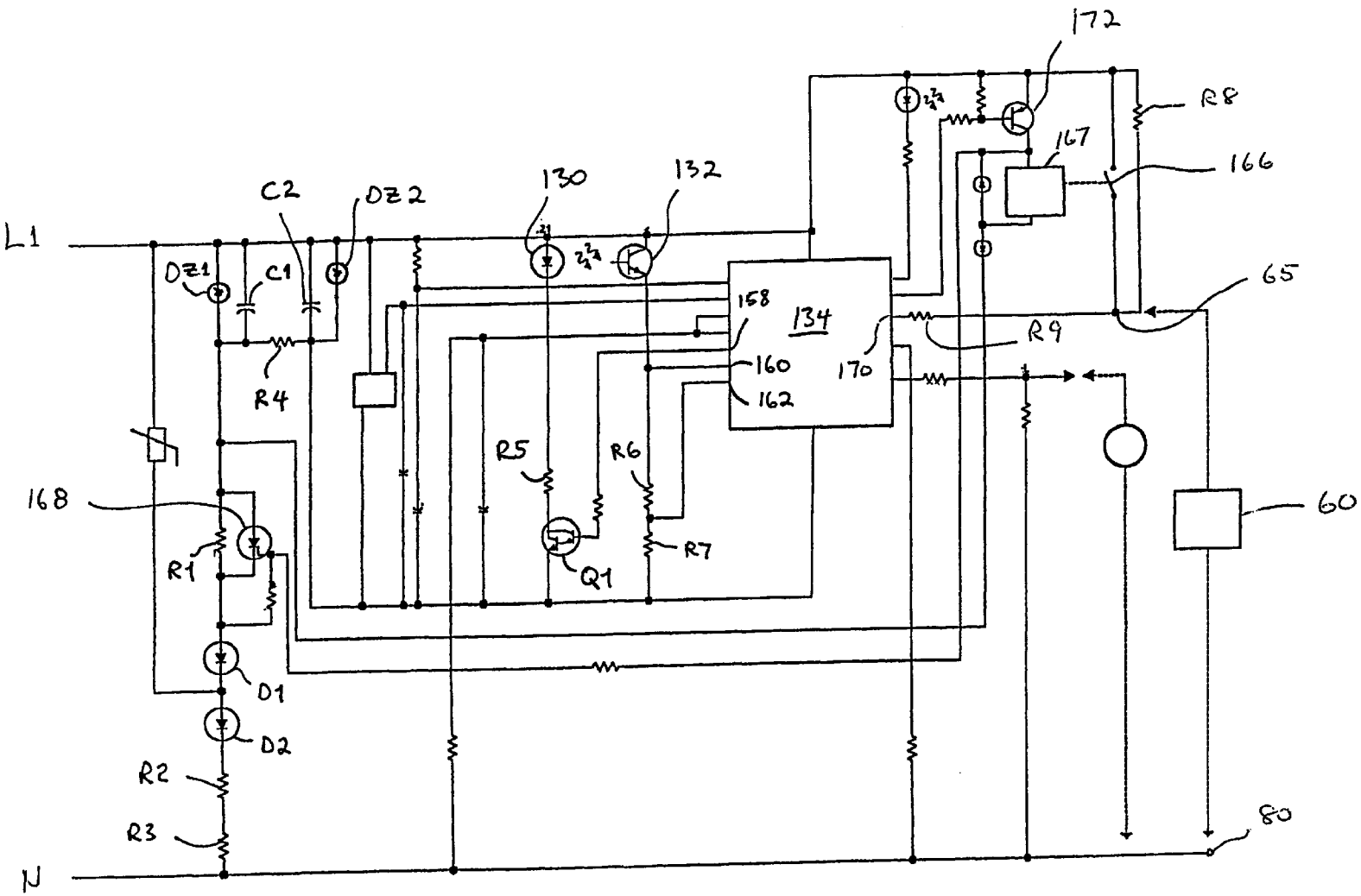
FIG. 9 is a schematic electrical diagram illustrating the circuitry of the optical control system associated with FIG. 8.

FIGS. 8 and 9 illustrate, in a more detailed manner, a second embodiment of the present invention. As in the first embodiment, an emitter 124 including a printed circuit board 125 and an infrared light emitting diode (LED) 130 and receiver 126 including a printed circuit board 127 and a phototransistor 132 are mounted on opposite sides of the ice bin 28 as part of an optic control system. Preferably, they are mounted on opposite side walls 21, 23 of the freezer cavity 16 about 1 inch below the top of the ice storage bin 28. Whenever the bin 28 is only partially filled with ice pieces, there is a clear line of sight 112 between LED 130 and the phototransistor 132. When the bin 28 is filled with ice, the line of sight between the LED 130 and the phototransistor 132 is blocked by ice pieces.

The core of the optical ice level sensing system is a small microcontroller or microprocessor 134 which may be mounted onto one of the printed circuit boards 125 or 127.

A $24V_{DC}$ power supply including a zenor diode DZ1, a filter capacitor C1, three voltage dropping resistors R1, R2 and R3, and rectifying diodes D1 and D2 is provided for relay function. The microprocessor 134 is supported by typical circuitry including a $5V_{DC}$ power supply which is provided by a second zenor diode DZ2, a second filter capacitor C2 and a voltage dropping resistor R4.

When the microcontroller 134 needs to check the ice bin level, its output 158 goes high to turn on darlington transistor Q1 which in turn places the LED 130 and a resistor R5 across the $5V_{DC}$ power supply. This current is high but brief and is supported by the charge stored up on the second filter capacitor C2. In response, LED 130 produces a short high energy IR burst which spans across the ice bin 28 and irradiates the phototransistor 132 with enough energy to saturate is—and turn it fully on—when it is not blocked by cloudy ice pieces.

One problem with an optical ice level sensing system is that ice can coat the optic elements such that sending and receiving IR signals is impaired. The signal may be degraded to a point where the optical system provides a false full ice bin signal when in fact the ice storage bin is not full of ice pieces. This occurs particularly quickly when the refrigerator is operated in a hot and humid location wherein when the freezer door 20 is opened, moisture immediately condenses onto the cold surfaces within the freezer compartment 16.

The present invention monitors to determine if such undesirable ice build-up or fogging is occurring. A fully turned ON phototransistor 132 effectively places resistors R6 and R7 across the $5V_{DC}$ power supply. Resistors R6 and R7 may be referred to as sensing resistors. The full voltage developed across both sensing resistors R6 and R7 is checked by the microcontroller 134 at input 160. The reduced voltage that develops across resistor R7 only is checked by the microcontroller at input 162. Both voltage values—at inputs 160 and 162—are high enough to be interpreted as a logic level "1" by the microcontroller 134 if the line of sight between the LED 130 and the phototransistor 132 is clear. If, however, fogging or ice begins to build up on the optic elements, both voltages will begin to sag because phototransistor 132 will not have turned fully ON. As some point, the voltage across both resistors R6 and R7, sensed at input 160, will be read as a logic level "1" while the voltage across just R7, sensed at input 162, will drop low enough to be read as a logic level "0". If ice pieces completely block the line of sight between the LED 130 and the phototransistor 132, the phototransistor will remain turned off and no voltage will be developed across the sensing resistors R6 and R7 such that the logic input at inputs 160 and 162 are at a logic level "0".

It can be understood, therefore, that by monitoring inputs 160 and 162, the microcontroller can determine if the ice bin is not completely full, is completely full, or if the optic elements are impaired by fogging or ice build up. Table 1 illustrates the logic inputs, the corresponding system status and action to be taken.

TABLE 1

Ice Level Sensing Logic

| Logic Level | | | |
|---|---|---|---|
| Input 160 | Input 162 | SYSTEM STATUS | ACTION |
| 0 | 0 | Bin full | No Ice Harvest-recheck periodically |

TABLE 1-continued

| Ice Level Sensing Logic | | | |
|---|---|---|---|
| Logic Level | | | |
| Input 160 | Input 162 | SYSTEM STATUS | ACTION |
| 1 | 1 | Bin not full | Harvest Ice |
| 1 | 0 | Fogged optics | Heat optic elements |

If the optics are sensed to be impaired by ice build up, they are cleared by heating the optic elements to drive off the ice and moisture on the elements. To accomplish this, resistors R2 and R3 are positioned adjacent the phototransistor 132 and the LED 130, respectively, and selectively turned into heaters. As discussed above, R2 and R3 are part of the $24V_{DC}$ power supply voltage dropping network. Normally, R2 and R3 are cool because they are in series with R1 which takes the brunt of the voltage drop due to its much higher resistance value. A thyristor switch 168 or silicon controlled rectifier (SCR) is provided such that current may be shunted around R1, thus leaving the full voltage drop to be shared by R2 and R3. This causes R2 and R3 to heat up. Since R2 is placed adjacent the phototransistor 132, it warms the phototransistor 132 above freezing to remove condensation and ice. Likewise, since R3 is placed adjacent the LED 130, it warms the LED 130 above freezing to remove condensation and ice. To effectively clear the optic elements 130 and 132 of any moisture or ice build up, the heater resistors R2 and R3 are heated for approximately 15 minutes.

It can be understood, therefore, that the microcontroller 134 may selectively shunt current around the resistor R1 such that the resistors R2 and R3 share the full voltage drop and heat up thereby heating the adjacent phototransistor 132 and LED 130 for driving off any ice or moisture build up which may occur on these optic elements. The microcontroller 132 selectively heats up resistors R2 and R3 when the logic level inputs indicated that the optic elements are impaired due to moisture or ice build up. However, if the ice bin 28 is filled with ice pieces, it is impossible to use the above circuitry for evaluating the condition of the optic elements. Accordingly, if the ice bin 28 is filled with ice pieces, the microcontroller 132 selectively causes resistors R2 and R3 to heat up periodically—such as once every 24 hours for 15 minutes.

As discussed above, the optic control system of the present invention, checks to determine if the ice bin 28 is full prior to each ice harvest. The optic control system determines when ice maker 22 is ready to harvest ice by monitoring the impedance of the ice maker 22.

In FIG. 9, the ice maker harvest circuit 60 is shown in block form, having one lead connected to N at point 80 and another lead connected at point 65 to the common junction of resistor R8, resistor R9 and a normally open relay switch 166. It can be understood that that ice maker harvest circuit 60 and the resistor R8 form a voltage divider between N and L1.

Prior to being ready to harvest ice pieces, when the thermostat switch 64 is open, the ice maker harvest circuit 60 has an infinite impedance, therefor point 65 is pulled up to the L1 potential. This is read as a logic level "1" during the positive half of each line cycle at input 170 of the microcontroller 134.

When the ice maker 22 is ready to harvest ice pieces the thermostat switch 66 closes and the impedance of ice maker harvest circuit 60 becomes very low as compared to resistor 8. Accordingly, point 65 is pulled to the N potential by the ice maker harvest circuit 60. this is read as a logic level "0" at input 170 of the microcontroller 134. In this way, the microcontroller 134 can, by sensing the impedance of the ice maker harvest circuit 60, determine when ice pieces are ready for harvesting. As discussed above, the optic control system will then check to determine whether the ice bin 28 is full of ice pieces prior to ice harvesting.

If the ice bin 28 is not filled with ice pieces and the line of sight between the optic elements is not blocked, the microcontroller 134 energizes relay 167 to close switch 166 via transistor 172. Switch 166 is held closed for a period of time—five minutes for example—and then opened. The microcontroller 134 reads the impedance of the ice maker harvest circuit via input 170 to determine of the ice harvest is complete. (infinite impedance) or still in process (low impedance). If the harvest is incomplete, the relay switch 166 will be closed for an additional time period.

When the bin 28 is full, the microcontroller 134 will check the ice bin level periodically—such as every five minutes. Once ice has been removed, a harvest will be initiated to refill the bin 28 with ice pieces.

The transistor 172 is a common voltage translator between the $5V_{DC}$ microcontroller 134 and the non $5V_{DC}$ loads. During an ice harvest, the transistor 172 is turned 100% on to keep the relay energized to close switch 166. This also results in having the SCR switch 168 latched on to boost the $24V_{DC}$ power supply.

When fog or ice is sensed on the optics as described above, transistor 172 is turned on at the beginning of each positive cycle of L1 just long enough to latch the SCR switch 168 on. This very short period is insufficient to energize the relay 167, but long enough to latch the SRC on. In this way, the heater resistors R2 and R3 can be heated up without energizing the relay 167.

It can be seen therefore, that it is possible to drive both the relay 167 and the resistors R2 and R3 together to achieve an ice harvest or the resistors R2 and R3 alone when the optic elements need clearing—using a single transistor. Of course, two transistors could also be used.

Figure 10:
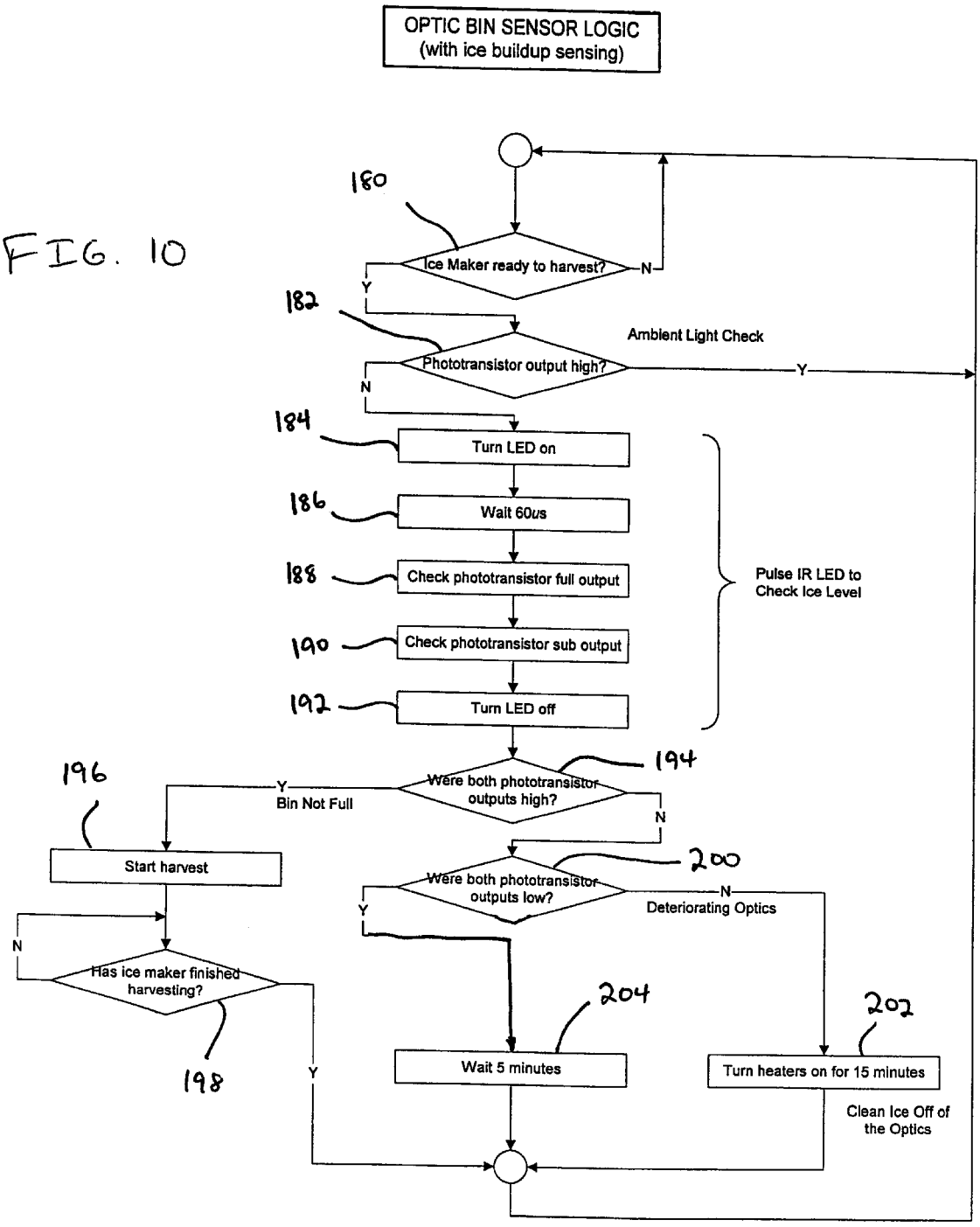
FIG. 10 is a flow chart illustrating the operation of the second embodiment of the present invention as disclosed in FIG. 9.

Turning now to FIG. 10, the operation of the second embodiment can be seen in flow chart form. At step 180, the control system checks to determine if the ice maker is ready to harvest. As discussed above, this may be done by sensing the impedance of the ice maker harvest circuit. If no, the system loops. If yes, the system queries whether the phototransistor 132 output is high at step 182. This step is designed to check for ambient light. If no ambient light is present, the system energizes the LED 130 such that IR light is directed toward the phototransistor 132, as shown at step 184. After a predetermined wait period—such as 60 us, shown at step 186. the phototransistor's full output is checked at input 160, shown at step 188. In step 190, the phototransitors sub output is checked at input 162. The LED 130 is then turned off, shown in step 192.

If both phototransistor outputs were high, as shown in step 194, indicating the bin 28 is not yet full, the ice harvest cycle is started—as shown in step 196. After the ice harvest is finished, step 198, the control loops back to monitoring whether the ice maker is ready to harvest—step 180.

If both phototransistor outputs were not high, then control moves to step 200 where the system queries if the both phototransistor outputs were low. If no, then the control knows that the optics are impaired and the optic elements are heated—as shown in step 202. If yes, the control knows that the ice bin is full. Control then moves to step 204 and pauses for 5 minutes before looping back to step 180.

The control system may also include a step for periodically heating the optic elements at least every 24 hours during period when the bin is full and there has not been an ice harvest.

As mentioned above, a problem with using optic elements in a freezer compartment to control the operation of an ice maker is the concern over moisture and ice build up. When the refrigerator 10 is operated in a hot and humid environment and the freezer door 20 is opened, moisture immediately condenses onto cold surfaces, including the LED 130 and the phototransistor 132. To address this concern, the present invention includes means for clearing the optic elements if it is detected that they are becoming impaired.

Figure 11A:
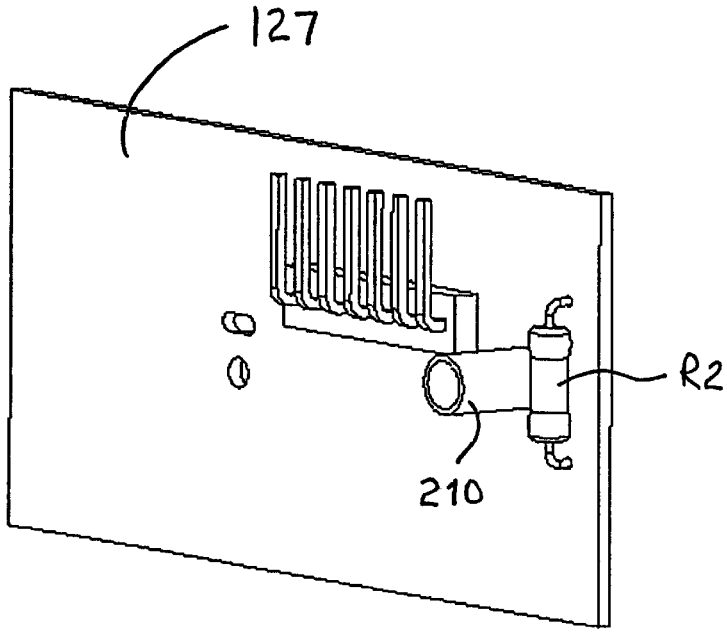
FIG. 11*a* is an enlarged view of the printed circuit board supporting the phototransistor which forms the light receiving element of the second embodiment.
Figure 11B:
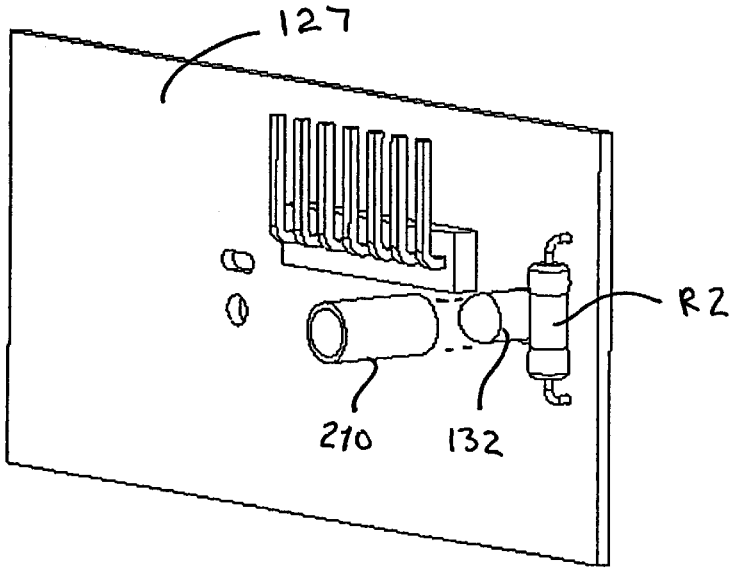
FIG. 11*b* is an enlarged, partially exploded view of the printed circuit board supporting the phototransistor which forms the light receiving element of the second embodiment.

FIGS. 11*a* and 11*b* illustrate a further way in which the present invention addresses the problem of optic element fogging. These FIGS. depict the printed circuit board 127 which forms part of the light receiving element 126 of the second embodiment. As can be seen, various electronic components may be present on the printed circuit board 127. The printed circuit board 127 also supports the elements associated with the phototransistor 132.

To minimize moisture condensation on the phototransistor 132, an aluminum cylinder or sleeve 210 is mounted to the printed circuit board to surround the phototransistor 132. In this way, air is trapped about the phototransistor such that when the freezer door is opened, warm humid air does not readily move into contact with the phototransistor 132. Moreover, the warm, humid air that does flow toward the phototransistor is cooled by the sleeve 210 such that moisture condenses out of the air and onto the sleeve 210. In this way, the aluminum cylinder 210 acts as a type of getter or desiccant, removing moisture from the air surrounding phototransistor 132.

As can be seen, the resistor R2 is provided adjacent the sleeve 210 such that when the optic elements are impaired due to moisture or ice build up, the resistor 210 heats the sleeve 210 which in turn heats the phototransistor 132.

It can be understood that the use of this novel sleeve system can be beneficially used with both the light emitting element or LED 130 and the light receiving element or phototransistor 132.

Therefore, the present invention provides a control system for an ice maker. More particularly, an optic control system is provided wherein the level of ice in a ice storage bin may be determined without the need for moving parts such as a bin arm. It can be appreciated that the optic sensing system of the present invention—shown in the form of a sensor pair—can be any type of system which includes a source of optical energy and a detector of optical energy. Although an LED and a phototransistor are shown, there may be other types of optical elements which could be used with the present invention. Moreover, it can be appreciated by one skilled in the art that the present invention may be practiced with any suitable energy within the electromagnetic spectrum of which light is one form of energy. For example, microwave absorption could also be used in the present invention.

While the present invention is described as detecting cloudy ice pieces, it can also be used to detect the level of clear ice pieces. It has been found that an IR signal passed through a number of clear ice pieces with random orientation, blocked the IR signal. In such instances, it appears that the IR signal is attenuated each time it encountered an ice surface that isn't 90° to the light path.

While the present invention has been described with reference to the above described embodiments, those of skill in the art will recognize that changes may be made thereto without departing from the scope of the invention as set forth in the appended claims.

We claim:

1. A method for controlling an ice making system, the ice making system including an ice maker and an ice storage bin for receiving ice pieces formed by the ice maker, the method comprising the steps of:

directing a beam of light from a first side of the ice storage bin, across the bin toward a second side of the ice storage bin using a light emitting optic element;

sensing for the beam of light at the second side of the ice storage bin using a light receiving optic element;

preventing further ice harvesting from the ice maker if ice pieces block the path of the beam of light;

determining if the emitting optic element or the receiving optic element is impaired due to ice or moisture build up; and heating the emitting and receiving optic elements if the optic elements are impaired due to ice or moisture build up.

2. The method for controlling an ice making system according to claim 1, wherein the ice making system includes a microcontroller and a power supply circuit and the step of heating the emitting and receiving optic elements further comprises:

heating the emitter optic element using a first resistor which forms part of the power supply circuit; and heating the receiver optic element using a second resistor which forms part of the power supply circuit.

3. The method for controlling an ice making system according to claim 2, further comprising the step of:

selectively controlling the voltage drop across the first and second resistor such that the first and second resistor heat up sufficient to clear the optic elements when optic elements are impaired due to ice or moisture build up.

4. The method for controlling an ice making system according to claim 1, further comprising the step of:

sensing the impedance of the ice maker for determining whether the ice maker is ready to harvest ice pieces, and when the ice maker is ready to harvest ice pieces; and directing a beam of light from a first side of the ice storage bin, across the bin toward a second side of the ice storage bin.

5. A control circuit for controlling an ice making system located in a freezer compartment of a refrigerator, the ice making system including an ice maker and an ice storage bin for receiving ice pieces formed by the ice maker, the control circuit comprising:

a microcontroller;

optic elements including a light emitting element for generating a light signal, the light emitting element being supported by the freezer compartment for directing the light signal across an upper portion of the bin and being selectively energized by the microcontroller, a light receiving element for receiving the light signal emitted by the light emitting element, the light receiving element being supported by the freezer compartment, the light receiving element changing states in response to the being irradiated with the light signal;

a first resistor located adjacent the light emitting element;

a second resistor located adjacent the light receiving element, wherein if the state of the light receiving element indicates that the optic elements are impaired due to ice or moisture build up, the microcontroller directs current sufficient current through the first resistor and the second resistor such that the first and second resistors heat up thereby heating the adjacent light emitting element and light receiving element for driving off any ice or moisture build up.

6. The control circuit for controlling an ice making system according to claim 5, further comprising:

a power supply circuit including the first resistor, the second resistor, and a third resistor, the first, second and third resistors all being in series, wherein if the state of the light receiving element indicates that the optic elements are impaired due to ice or moisture build up, the microcontroller shunts current around the third resistor such that the first and second resistors share the full voltage drop and heat up thereby heating the adjacent light emitting element and light receiving element for driving off any ice or moisture build up.

7. The control circuit for controlling an ice making system according to claim 5, wherein the light emitting element is a light emitting diode and the light receiving element is a phototransistor.

8. The control circuit for controlling an ice making system according to claim 7, the control circuit further comprising:

a low voltage power supply circuit;

a transistor having a gate connected to the microcontroller, the transistor being in series with the light emitting diode across the low voltage power supply wherein when the ice maker is ready to harvest ice pieces the microcontroller turns the transistor on to cause the light emitting diode to generate an infrared signal and the infrared signal irradiates the phototransistor if it is not blocked by ice pieces causing the phototransistor to turn on; and a first sensing resistor and a second sensing resistor connected in series with the phototransistor across the low voltage power supply such that when the phototransistor is turned on, the first and second sensing resistors are connected across the lower low voltage power supply, wherein the microcontroller monitors the voltage across the first and second sensing resistors to determine if the optic elements are impaired due to ice or moisture build up.

9. A method for controlling an ice making system, the ice making system including an ice maker and an ice storage bin for receiving ice pieces formed by the ice maker, the method comprising the steps of:

directing a beam of light from a first side of the ice storage bin, across the bin toward a second side of the ice storage bin using an emitter optic element;

sensing for the beam of light at the second side of the ice storage bin using a receiver optic element;

preventing further ice harvesting from the ice maker if ice pieces block the path of the beam of light; and periodically heating the emitter and receiver optic elements to remove any ice or moisture build up.

10. The method for controlling an ice making system according to claim 9, wherein the ice making system includes a microcontroller and a power supply circuit and the step of periodically heating the emitter and receiver optic elements further comprises:

heating the emitter optic element using a first resistor which forms part of the power supply circuit; and heating the receiver optic element using a second resistor which forms part of the power supply circuit.

11. The method for controlling an ice making system according to claim 10, further comprising the step of:

selectively controlling the voltage drop across the first and second resistor such that the first and second resistor heat up sufficient to clear the optic elements.

12. The method for controlling an ice making system according to claim 1, further comprising the step of:

sensing the impedance of the ice maker for determining whether the ice maker is ready to harvest ice pieces, and when the ice maker is ready to harvest ice pieces; and directing a beam of light from a first side of the ice storage bin, across the bin toward a second side of the ice storage bin.

* * * * *